US008422728B2

(12) United States Patent
Yoshida

(10) Patent No.: US 8,422,728 B2
(45) Date of Patent: Apr. 16, 2013

(54) ELECTROMAGNETIC CONVERTER

(75) Inventor: Shunji Yoshida, Tokyo (JP)

(73) Assignee: Mitsubhishi Electric Engineering Company, Limited, Tokyo (JP)

( * ) Notice: Subject to any disclaimer, the term of this patent is extended or adjusted under 35 U.S.C. 154(b) by 160 days.

(21) Appl. No.: 12/967,487

(22) Filed: Dec. 14, 2010

(65) Prior Publication Data

US 2011/0206231 A1 Aug. 25, 2011

(30) Foreign Application Priority Data

Feb. 22, 2010 (JP) ..... 2010-036151

(51) Int. Cl.
*H04R 11/02* (2006.01)

(52) U.S. Cl.
USPC ..... 381/431; 381/399; 381/176; 381/403

(58) Field of Classification Search ..... 381/399, 381/176, 431, 404, 403
See application file for complete search history.

(56) References Cited

U.S. PATENT DOCUMENTS 6,526,151 B1 * 2/2003 Peng ..... 381/403
8,031,902 B2 * 10/2011 Takewa ..... 381/431

FOREIGN PATENT DOCUMENTS

JP 2000-102094 A 4/2000
JP 2008-113368 A 5/2008

* cited by examiner

*Primary Examiner* — Davetta W Goins
*Assistant Examiner* — Amir Etesam
(74) *Attorney, Agent, or Firm* — Sughrue Mion, PLLC

(57) ABSTRACT

An electromagnetic converter includes a magnetic circuit having permanent magnets, a lower frame for fixing magnetic pole faces of these permanent magnets thereto, an upper frame having an opening formed therein on a side of the other magnetic pole faces of the permanent magnets and plates fixed to the other magnetic pole faces, and a diaphragm having a voice coil pattern arranged on side portions thereof in a direction of the length thereof and on a top portion thereof in a direction of the width thereof. Protruding portions join between these side portions. The periphery of the top portion is joined to the periphery of the opening of the upper frame via an upper gasket. A flange at the edges of the four side portions is joined to an inner surface of the upper frame, i.e., an inner portion of the magnetic circuit via a lower gasket.

6 Claims, 4 Drawing Sheets

ELECTROMAGNETIC CONVERTER

BACKGROUND OF THE INVENTION

1. Field of the Invention

The present invention relates to an electromagnetic converter that carries out sound reproduction from an audio signal by using a combination of a permanent magnet and a diaphragm.

2. Description of Related Art

As conventional speakers having a structure of forming a diaphragm and a voice coil pattern into an integral piece, there have been provided, for example, a plane type sound converter as disposed in patent reference 1 and a speaker as disclosed in patent reference 2. The plane type sound converter as disposed in patent reference 1 has a diaphragm which is formed by forming a spiral voice coil pattern on a sheet made from polyimide which is a thermosetting resin, polyethylene terephthalate (PET) which is a thermoplastic resin, or a liquid crystal polymer, and bending both sides of the sheet in such a way that the bent sheet has a U-shaped cross section. A top portion of the diaphragm and a frame are joined to each other by using an edge having elasticity, and they are held in such a way that the voice coil pattern on both the side surfaces of the diaphragm is positioned in a region where a flux of magnetic induction occurs in the magnetic circuit. Therefore, even if the amplitude of the diaphragm becomes large, the lengths of up-and-down displacements of the voice coil pattern can be made to fall within the region where the flux of magnetic induction occurs.

A problem is however that because in this diaphragm only both the sides in a direction of the length of the diaphragm are bent, but both sides in a direction of the width of the diaphragm are not bent, the rigidity of the diaphragm is low and an unusual sound easily occurs due to unnecessary resonance caused by the vibration of the diaphragm. A further problem is that because a holding mechanism including the edge for fixing the diaphragm to the frame cannot be joined to anything other than the top portion of the diaphragm, the piston vibration of the diaphragm fluctuates at the time when the diaphragm has a large amplitude, and a magnetic gap failure easily occurs due to rolling.

In contrast with this, the speaker as disclosed in patent reference 2 has a dome-shaped diaphragm having a U-shaped cross section which is formed by forming a voice coil pattern on a polyimide sheet or a thermosetting resin sheet made from a glass resin and an epoxy resin, such as a prepreg laminated sheet, in advance, and then hot-forming them. While the perimeter of the diaphragm and a frame are joined to each other by using an edge, a holding plate is fixed to an inner portion of the diaphragm and is also joined to a damper disposed on the frame. Therefore, the rigidity of the diaphragm can be improved because the diaphragm is formed into a dome shape, and the holding structure for holding the diaphragm can be redundant, but partially.

RELATED ART DOCUMENT

Patent Reference

Patent reference 1: JP,2008-113368,A

Patent reference 2: JP,2000-102094,A

Conventional electromagnetic converters are constructed as above. A problem with the structure as disclosed by patent reference 1 is therefore that an unusual sound occurs due to the low rigidity of the diaphragm and a magnetic gap failure occurs due to disorder of the piston vibration, as mentioned above. In contrast with this, although the problem of the rigidity insufficiency of the diaphragm can be solved by using the structure as disclosed by patent reference 2, the problem that the piston vibration of the diaphragm fluctuates cannot be solved because it is able to dispose the damper only partially.

A further problem with the structure as disclosed by patent reference 2 is that because the magnetic circuit has to be divided in order to fix the damper to the frame, the component count increases. Furthermore, in a case in which the magnetic circuit is divided into parts and the parts are arranged, this division and arrangement causes nonuniformity in the flux density and decrease in the flux density.

In addition, in order to acquire a diaphragm having a solid structure of shape as disclosed by patent reference 2 by using a thermosetting resin sheet, after the thermosetting resin sheet on which a voice coil pattern is formed into a solid structure, what is necessary is just to cure the thermosetting resin sheet by heat-treatment. However, in order to acquire such a diaphragm having a solid structure by using a thermoplastic resin sheet, it is necessary to lengthen the thermoplastic resin sheet on which a voice coil pattern is formed by draw forming with heat pressing to shape the thermoplastic resin sheet into a solid. A problem is therefore that because the elongation percentage of the thermoplastic resin sheet differs from that of the voice coil pattern formed on this sheet, the draw forming causes a break in the coil and the sheet. A further problem is that the cost of the thermosetting resin is higher than that of a thermoplastic resin.

SUMMARY OF THE INVENTION

The present invention is made in order to solve the above-mentioned problems, and it is therefore an object of the present invention to provide a high-performance electromagnetic converter in which a diaphragm is made to vibrate like a piston by a redundant holding structure having a small component count.

In accordance with the present invention, there is provided an electromagnetic converter including: a magnetic circuit having a permanent magnet, a frame fixing one magnetic pole face of the permanent magnet thereto and having an opening on a side of another magnetic pole face of the permanent magnet, and a plate fixed to the other magnetic pole face; a diaphragm having a top portion positioned to cover the plate and four side portions formed in such a way as to extend from the top portion toward the permanent magnet, and positioned between the plate and the opening of the frame, and having a voice coil pattern formed on one surface or both surfaces thereof; a first holding portion joined to a periphery of the top portion of the diaphragm, and a periphery of the opening of the frame, for holding the diaphragm in such a way that the diaphragm can move; and a second holding portion joined to edges of side portions of the diaphragm, and an inner surface of the frame, for holding the diaphragm in such a way that the diaphragm can move.

Because in the electromagnetic converter in accordance with the present invention, the periphery of the top portion of the diaphragm is joined to the periphery of the frame opening, and the edges of the side portions of the diaphragm are joined to the inner surface of the frame, the diaphragm can be made to vibrate like a piston by the redundant holding structure having a small component count, and the electromagnetic converter can achieve higher performance.

Further objects and advantages of the present invention will be apparent from the following description of the preferred embodiments of the invention as illustrated in the accompanying drawings.

BRIEF DESCRIPTION OF THE DRAWINGS

FIG. 4(*b*) is a view showing the structure of a back side of the diaphragm;

DETAILED DESCRIPTION OF THE PREFERRED EMBODIMENTS

Embodiment 1

Figure 1:
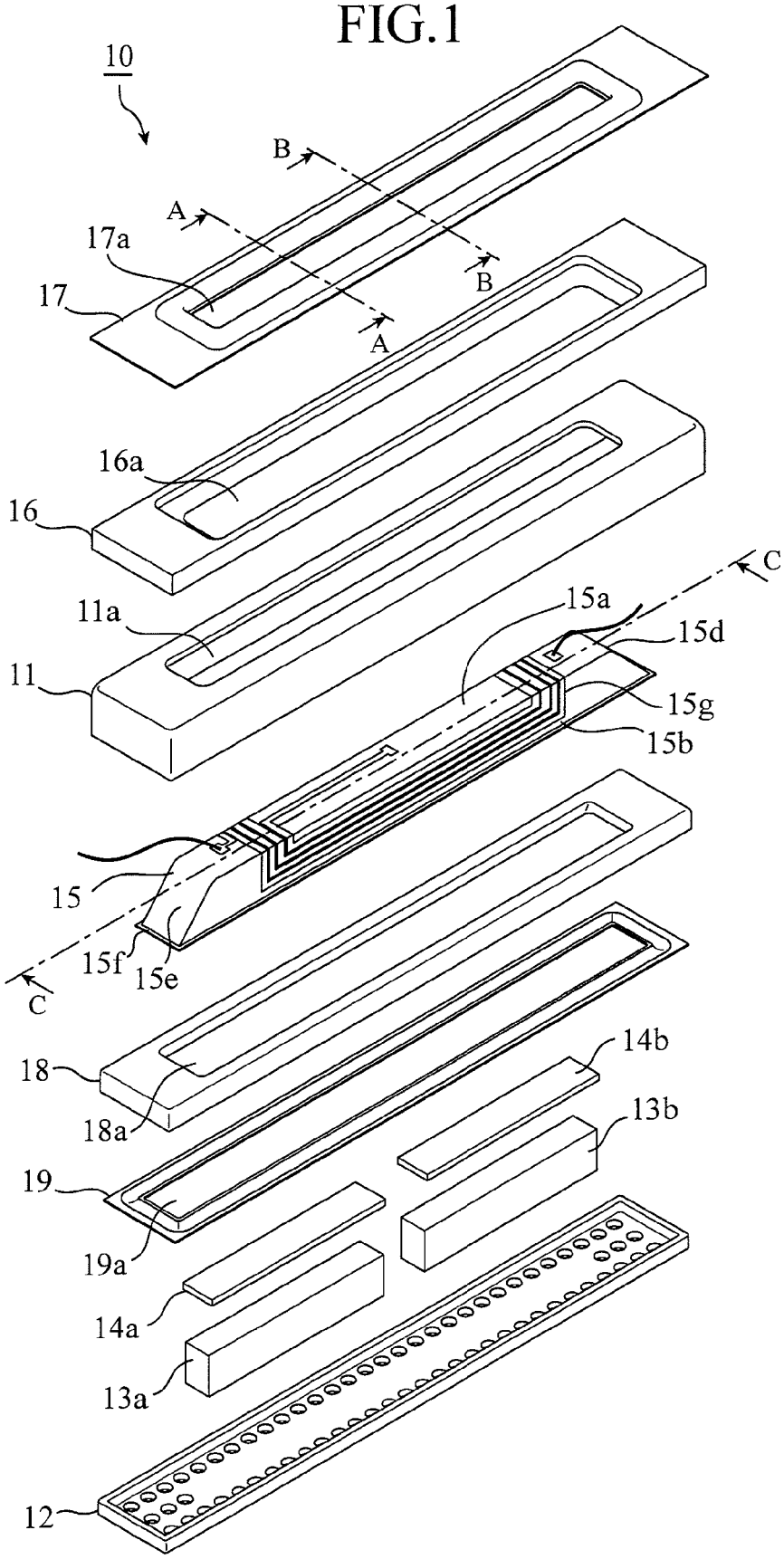
FIG. 1 is an exploded perspective view showing the structure of an electromagnetic converter in accordance with Embodiment 1 of the present invention.
Figure 2:
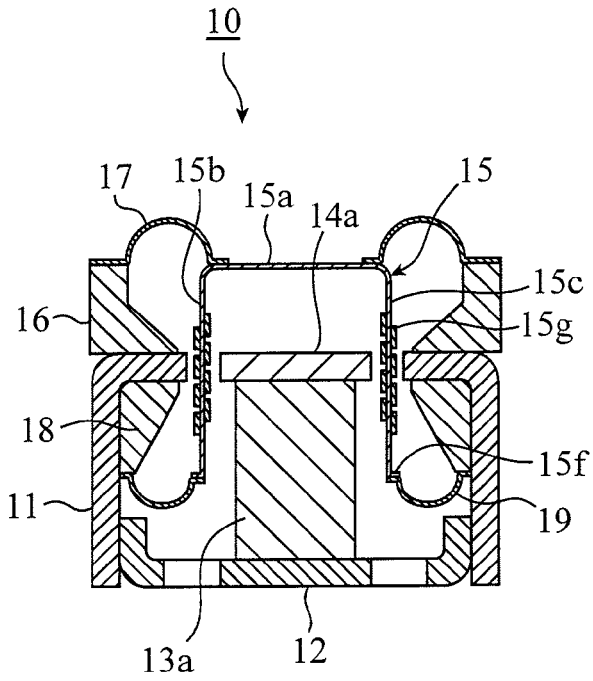
FIG. 2 is a cross-sectional view, taken along the A-A line shown in FIG. 1, of the electromagnetic converter in accordance with Embodiment 1 of the present invention.
Figure 3:
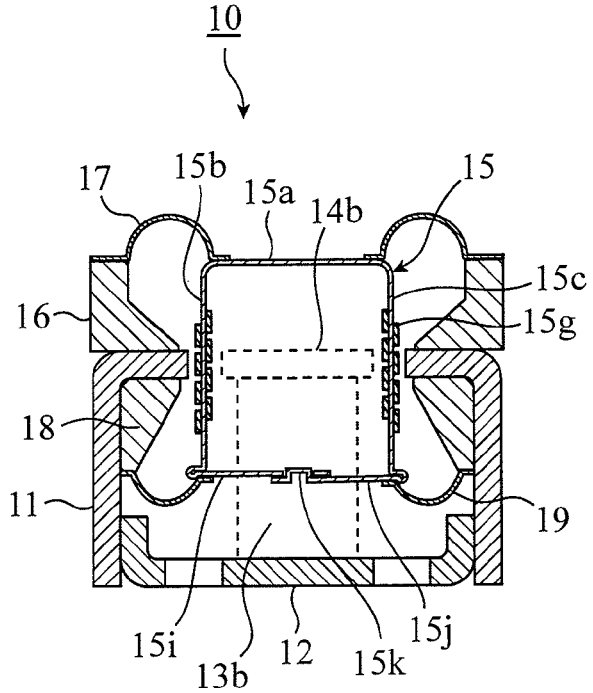
FIG. 3 is a cross-sectional view, taken along the B-B line shown in FIG. 1, of the electromagnetic converter in accordance with Embodiment 1 of the present invention.
Figure 4:
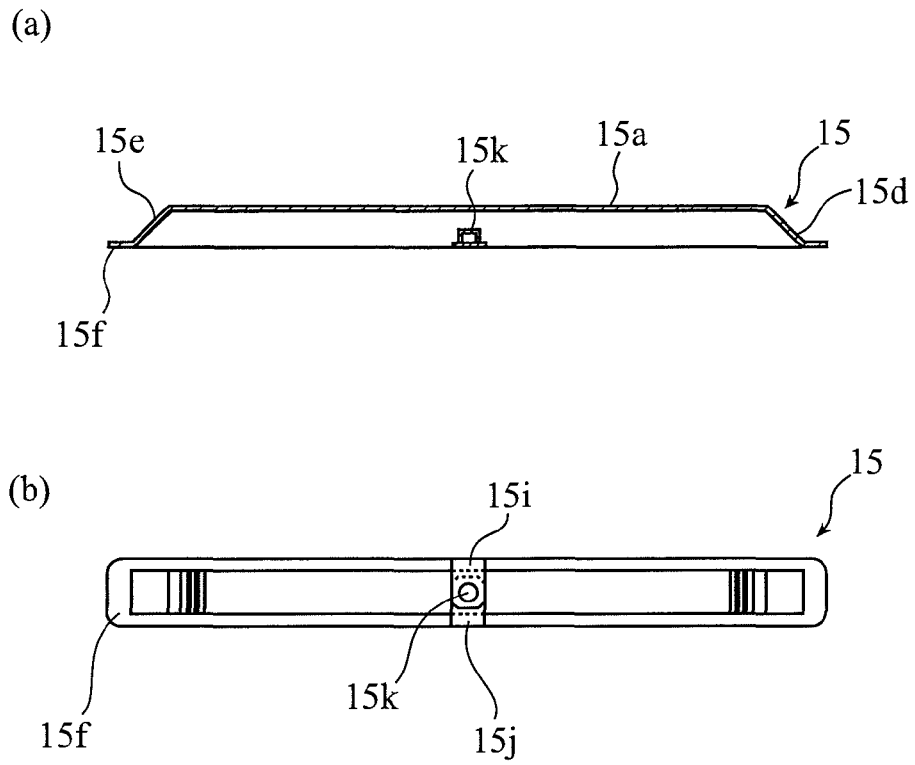
FIG. 4(*a*) is a cross-sectional view, taken along the C-C line shown in FIG. 1, of a diaphragm of the electromagnetic converter in accordance with Embodiment 1 of the present invention.

FIG. 1 is an exploded perspective view showing the structure of an electromagnetic converter 10 in accordance with Embodiment 1 of the present invention. A cross-sectional view, taken along the A-A line of FIG. 1, of the electromagnetic converter is shown in FIG. 2, and a cross-sectional view, taken along the B-B line of FIG. 1, of the electromagnetic converter is shown in FIG. 3. A cross-sectional view of a diaphragm 15 taken along the C-C line of FIG. 1 is shown in FIG. 4(*a*), and the structure of a back side of the diaphragm is shown in FIG. 4(*b*). The electromagnetic converter 10 shown in the figures is comprised of a magnetic circuit which consists of an upper frame 11, a lower frame 12, two permanent magnets 13*a* and 13*b*, and two plates 14*a* and 14*b*, the diaphragm 15, a first holding portion which consists of an upper gasket 16 for holding this diaphragm 15 above the magnetic circuit, and an edge 17, and a second holding portion which consists of a lower gasket 18 for holding the diaphragm 15 inside the magnetic circuit, and a damper 19. In this Embodiment 1, although the upper and lower sides of the electromagnetic converter are distinguished for the sake of explanation, any one of them can be referred to as the upper side actually.

The lower frame 12 fix one magnetic pole face of each of the permanent magnets 13*a* and 13*b* thereto. The upper frame 11 covers the lower frame 12, together with the permanent magnets 13*a* and 13*b*, and has an opening 11*a* at substantially the same vertical position as the other magnetic pole face of each of the permanent magnets 13*a* and 13*b*. The plates 14*a* and 14*b* are adhered to the other magnetic pole faces of the permanent magnets 13*a* and 13*b* respectively. Therefore, the plates 14*a* and 14*b* are positioned at substantially the same vertical position as the opening 11*a*, and the flux density between the plates 14*a* and 14*b* and the opening 11*a* becomes high. The permanent magnets 13*a* and 13*b* are arranged separately from each other and the plates 14*a* and 14*b* are arranged separately from each other in such a way that they are not in contact with protruding portions 15*i* and 15*j* formed on lower parts of side portions 15*b* and 15*c* in a direction of the length of the diaphragm 15.

A thermoplastic resin sheet, such as PEI (polyetherimide), PEN (polyethylenenaphthalate), PET, or PEEK (polyether ether ketone), is used to form the diaphragm 15. By edging a conductive foil (made from copper, aluminum, or the like), a voice coil pattern 15*g* is formed in a region on a surface or both surfaces of the thermoplastic resin sheet which has not been subjected to solid forming, the region corresponding to a top portion 15*a* and the side portions 15*b* and 15*c* in the direction of the length of the diaphragm. After that, the thermoplastic resin sheet is formed with hot press forming to have a solid structure. By forming the four sides of the diaphragm 15 into the four side portions 15*b* to 15*e* extending downwardly from the top portion 15*a* with hot press forming, the rigidity of the diaphragm 15 can be improved. In the illustrated example, the side portions 15*b* and 15*c* in the direction of the length of the diaphragm are formed in such a way as to extend vertically downwardly from the top portion 15*a*, and the side portions 15*d* and 15*e* in a direction of the width of the diaphragm are formed in such a way as to extend slantwise downwardly from the top portion 15*a*. Because the side portions 15*b* and 15*c* in the direction of the length of the diaphragm on which the voice coil pattern 15*g* is formed can be formed at the time of hot press forming while the thermoplastic resin sheet is not lengthened, there is no fear of occurrence of a break due to the difference between the elongation percentage of the thermoplastic resin sheet and that of the voice coil pattern.

Furthermore, a flange 15*f* is formed at the edges of the side portions 15*b* to 15*e*. This flange 15*f* serves as a fixing portion at the time when the diaphragm 15 is adhered to the damper 19. In addition, on parts of the edges of the side portions 15*b* and 15*c*, the tongue-shaped protruding portions 15*i* and 15*j* which are extensions of the thermoplastic resin sheet are formed. A protruding portion 15*k* for fitting is formed in one of these protruding portions 15*i* and 15*j* and a hole is formed in the other one, and the protruding portion 15*k* for fitting is inserted into the hole and is adhered to the hole in such a way that the protruding portions are formed into a beltlike shape. As a result, the protruding portions serve as a reinforcement portion against vibrations occurring at the time when the electromagnetic converter is driven.

In the illustrated example, the voice coil pattern 15*g* is formed on each of both the front and rear surfaces of the diaphragm 15. In this case, the voice coil pattern formed on each of the front and rear surfaces of each of the side portions 15*b* and 15*c* in the direction of the length of the diaphragm 15 is arranged in such a way that the voice coil pattern formed on the front surface of each of the side portions partially overlap that formed on the rear surface of each of the side portions, in order to improve the rigidity of the diaphragm 15.

The periphery of the opening 17*a* of the edge 17 is joined to the periphery of the top portion 15*a* of the diaphragm 15, and the outer periphery of the edge 17 is joined to the periphery of the opening 16*a* of the upper gasket 16. The upper gasket 16 is adhered to the upper surface of the upper frame 11. These upper gasket 16 and edge 17 serve as the first holding portion to hold the diaphragm 15 in such a way that the diaphragm can move upwardly and downwardly. As an alternative, the outer periphery of the edge 17 can be joined directly to the upper frame 11 without using the upper gasket 16. In this case, because it is necessary to ensure a predetermined distance between the top portion 15*a* and the plates 14*a* and 14*b* in such a way that the diaphragm 15 does not collide with the plates 14*a* and 14*b* when the diaphragm 15 moves upwardly and downwardly, what is necessary is, for example, to make a part of the top surface of the upper frame 11 protrude upwardly to adjust the vertical position of the diaphragm or to make the outer periphery of the edge 17 extend toward the top surface of the upper frame 11.

The periphery of the opening 19*a* of the damper 19 is joined to the flange 15*f* formed at the edges of the side portions of the diaphragm 15, and the outer periphery of the damper 19 is joined to the periphery of the opening 18*a* of the lower gasket 18. The lower gasket 18 is adhered to an upper rear surface of the upper frame 11, i.e., the inner portion of the magnetic circuit. These lower gasket 18 and damper 19 serve as the second holding portion to hold the diaphragm 15 in such a way that the diaphragm 15 can move upwardly and downwardly. As an alternative, the periphery of the damper 19 can be joined directly to the inner portion of the upper frame 11 without using the lower gasket 18.

In a typical electromagnetic converter having a diaphragm of conical shape, a material which does not have air permeability is used as an edge. In contrast, in the electromagnetic converter 10 in accordance with this Embodiment 1, a material having good air permeability or a structure which enables the air to pass therethrough can be used as the edge 17. Accordingly, sound occurring from the side portions 15*b* and 15*c* of the diaphragm 15 can be used. More specifically, sound occurring from the side portions 15*b* and 15*c* of the diaphragm 15 passes through the edge 17 and is combined with sound occurring from the top portion 15*a*, and, as a result, the high-pitched sound reproduction performance of the electromagnetic converter 10 is improved.

Figure 5:
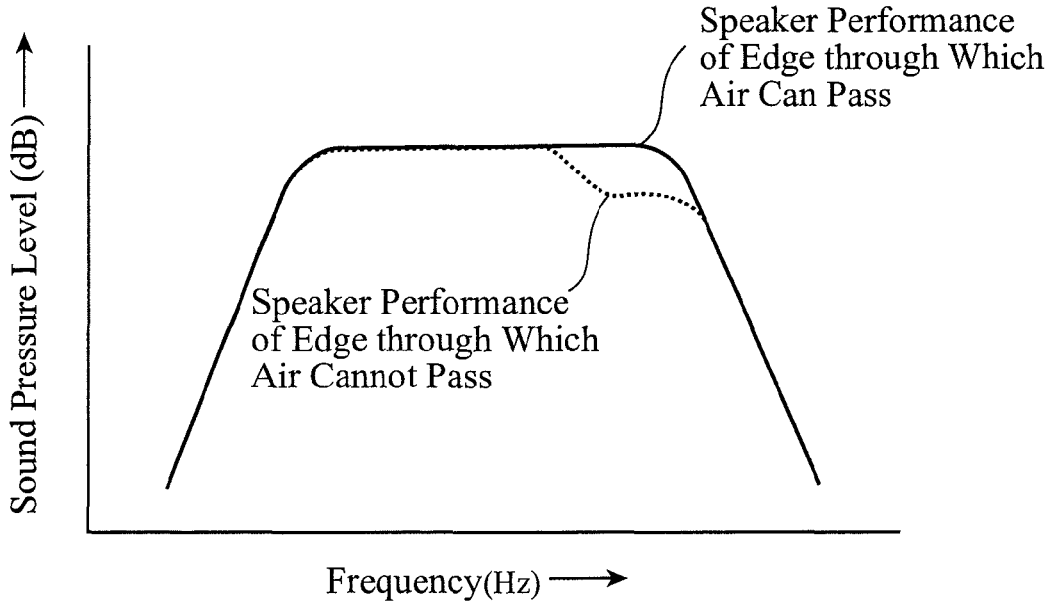
FIG. 5 is a graph of the output characteristics of the electromagnetic converter in accordance with Embodiment 1.

FIG. 5 is a graph showing a comparison in the reproduction performance of the electromagnetic converter 10 between different materials from each of which the edge 17 is made, and the vertical axis shows the sound pressure level and the horizontal axis shows the frequency. This figure shows, as an example, the frequency characteristics of the electromagnetic converter 10 in a case in which the edge 17 is made from an elastomer through which the air cannot pass (the dotted line shows the frequency characteristics of the electromagnetic converter in this case), and the frequency characteristics of the electromagnetic converter 10 in a case in which the edge 17 is made from a cloth in which a polyester through which the air can pass is woven in such a way as to be non-dense (the solid line shows the frequency characteristics of the electromagnetic converter in this case). It can be seen from this graph that the use of the edge 17 of air permeability provides better high-pitched sound characteristics. In this embodiment, in order to prevent sound of antiphase coming out from the back surface of the diaphragm 15 from emitting from the front surface of the electromagnetic converter 10, the damper 19 is made from a material through which the air does not pass or is made to have a structure which prevents the air from passing therethrough.

Next, the principle of operation of the electromagnetic converter 10 will be explained. When a current (an audio signal) is furnished to the voice coil patterns 15*g* from outside the electromagnetic converter 10, the current flowing through the voice coil patterns 15*g* is electromagnetically coupled to the flux of magnetic induction occurring between the opening 11*a* of the upper frame 11 and the plates 14*a* and 14*b* and a driving force occurs according to the Fleming's law. The driving force which has occurred causes the diaphragm 15 to vibrate like a piston in the upward and downward directions to generate an acoustic wave. Because the entire periphery of the top portion 15*a* of the diaphragm 15 and the entire periphery of the flange 15*f* are held by the first and second holding portions respectively in such a way that the top portion 15*a* of the diaphragm 15 and the flange 15*f* can move upwardly and downwardly, the piston vibration which is an up-and-down parallel translation does not fluctuate even at the time when the diaphragm has a large amplitude. Therefore, no magnetic gap failure due to rolling does not occur.

Furthermore, because the reinforcement portion in which the protruding portions 15*i* and 15*j* are fitted and adhered to each other can suppress unnecessary resonance of the side portions 15*b* and 15*c*, the diaphragm 15 is prevented from colliding with the permanent magnets 13*a* and 13*b* and the plates 14*a* and 14*b*, and no hit sound occurs, either. In addition, because the voice coil pattern formed on each of the front and rear surfaces of each of the side portions 15*b* and 15*c* in the direction of the length of the diaphragm 15 is constructed in such a way that the voice coil pattern formed on the front surface of each of the side portions partially overlap that formed on the rear surface of each of the side portions, the rigidity of the side portions 15*b* and 15*c* increases and the occurrence of unnecessary resonance is reduced. Therefore, the occurrence of an unusual sound can be suppressed.

As mentioned above, the electromagnetic converter 10 in accordance with Embodiment 1 is constructed in such a way as to include: the magnetic circuit including the permanent magnets 13*a* and 13*b*, the lower frame 12 for fixing magnetic pole faces of these permanent magnets 13*a* and 13*b* thereto, the upper frame 11 having the opening 11*a* formed therein on a side of the other magnetic pole faces of the permanent magnets, and the plates 14*a* and 14*b* fixed to the other magnetic pole faces of the permanent magnets; the diaphragm 15 having the top portion 15*a* positioned to cover these plates 14*a* and 14*b* and the four side portions 15*b* to 15*e* formed in such a way as to extend from the top portion 15*a* toward the permanent magnets 13*a* and 13*b*, and positioned between the plates 14*a* and 14*b* and the opening 11*a* of the upper frame 11, and having the voice coil pattern 15*g* formed on one surface or both surfaces thereof; the upper gasket 16 adhered to the periphery of the opening 11*a* of the upper frame 11; the edge 17 joined to both the periphery of the top portion 15*a* of the diaphragm 15 and the periphery of the opening 16*a* of the upper gasket 16, for holding the diaphragm 15 in such a way that the diaphragm 15 can move; the lower gasket 18 adhered to the inner surface of the upper frame 11; and the damper 19 joined to both the flange 15*f* of the diaphragm 15, and the periphery of the opening 18*a* of the lower gasket 18, for holding the diaphragm 15 in such a way that the diaphragm 15 can move. Therefore, the diaphragm 15 can be made to vibrate like a piston by the redundant holding structure having a small component count, and the occurrence of an unusual sound can be prevented. Furthermore, it becomes unnecessary to divide the magnetic circuit into parts, unlike in the case of a conventional electromagnetic converter, and hence the component count of the electromagnetic converter in accordance with this embodiment does not increase and the cost of the electromagnetic converter in accordance with this embodiment does not increase. In addition, because it is not necessary to divide the magnetic circuit into parts and arrange these parts, nonuniformity does not occur in the flux density and the flux density does not decrease.

Furthermore, in the electromagnetic converter in accordance with Embodiment 1, the diaphragm 15 is constructed in such a way that it includes the four side portions 15*b* to 15*e* which are formed by hot-press-forming both side end portions in the direction of the length of a thermoplastic resin sheet and both side end portions in a direction of the width of the thermoplastic resin sheet, and the voice coil pattern 15*g* is arranged on the side portions 15*b* and 15*c* in the direction of the length of the thermoplastic resin sheet and on the top portion 15*a*. Therefore, instead of a high-cost thermosetting resin, a low-cost thermoplastic resin can be used to form the diaphragm, and, as a result, the electromagnetic converter 10 can be provided at a low cost.

In addition, in the electromagnetic converter in accordance with Embodiment 1, the reinforcement portion that joins between the side portions 15*b* and 15*c* is constructed by extending the two side portions 15*b* and 15*c* facing each other of the diaphragm 15 to form the tongue-shaped protruding portions 15*i* and 15*j*, and then adhering them to each other. Therefore, the diaphragm 15 can be reinforced with a smaller number of parts and without newly disposing any structure for reinforcing the diaphragm 15.

Furthermore, although not illustrated in the figures, a rib structure or a rugged structure for improving the rigidity of the diaphragm 15 can be formed in the tongue-shaped protruding portions 15*i* and 15*j* of the diaphragm 15. In a case in which such a structural reinforcement member is formed in the beltlike protruding portions 15*i* and 15*j* respectively extending from the side portions 15*b* and 15*c*, the rigidity of the diaphragm 15 can be further improved, and the performance of the electromagnetic converter 10 can be improved. In addition, the joint between the side portions 15*b* and 15*c* is not limited only to the single one with the adhesion between the protruding portions 15*i* and 15*j*. As an alternative, the side portions 15*b* and 15*c* can be formed in such a way as to include a pair of protruding portions formed on each of two or more parts thereof, and to be joined to each other at a larger number of joints.

Furthermore, the voice coil pattern 15*g* in accordance with Embodiment 1 can be formed on each of the front and rear surfaces of each of the side portions 15*b* and 15*c* of the diaphragm 15, and can be constructed in such a way that the voice coil pattern formed on the front surface of each of the side portions partially overlap that formed on the rear surface of each of the side portions. Therefore, portions formed of only the thermoplastic resin sheet whose strength is lower as compared with the conductive patterns each consisting of a material having high rigidity such as copper, aluminum, or alloy can be eliminated, and the rigidity of the diaphragm 15 can be further improved and the performance of the electromagnetic converter 10 can be improved.

In addition, because the edge 17 in accordance with Embodiment 1 is from a material having good air permeability or has a structure which enables the air to pass therethrough, the sound occurring from the top portion 15*a* and the side portions 15*b* to 15*e* of the diaphragm 15 can be made to come out of the front surface of the electromagnetic converter 10. As a result, the high-pitched sound reproduction performance can be improved. At this time, in a case in which the damper 19 is made from a material through which the air does not pass or is made to have a structure which prevents the air from passing therethrough, the sound of antiphase coming out from the back surface of the diaphragm 15 can be prevented from emitting from the front surface of the electromagnetic converter 10, and the performance of the electromagnetic converter 10 can be further improved.

Figure 6:
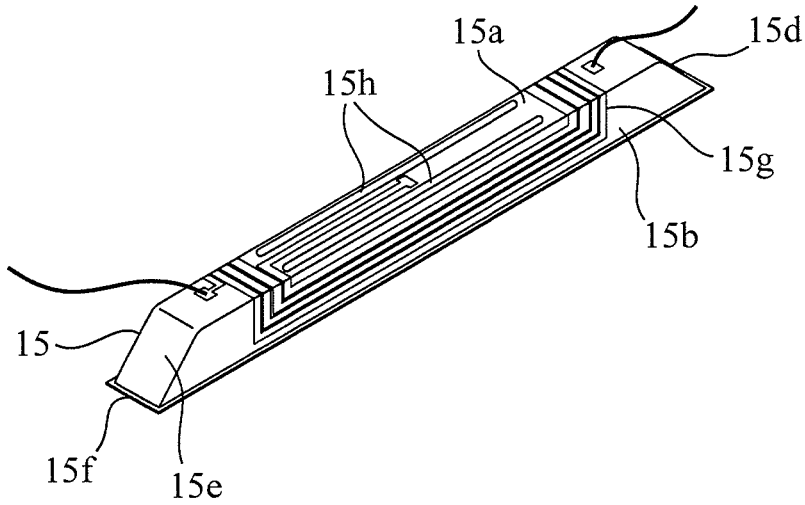
FIG. 6 is an appearance perspective view showing a variant of the diaphragm of the electromagnetic converter in accordance with Embodiment 1.
Figure 7:
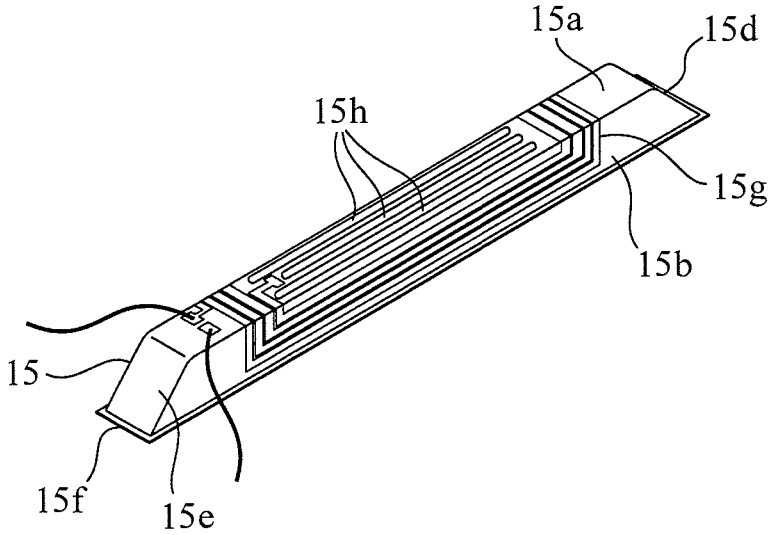
FIG. 7 is an appearance perspective view showing another variant of the diaphragm of the electromagnetic converter in accordance with Embodiment 1.

A structural reinforcement member 15*h* for improving the rigidity of the diaphragm 15 can be formed in the top portion 15*a* of the diaphragm 15. FIGS. 6 and 7 are perspective views each showing the structure of the structural reinforcement member 15*h* disposed in the diaphragm 15 in accordance with Embodiment 1. This structural reinforcement member 15*h* can be implemented using a rib structure or a rugged structure. Furthermore, the direction in which ribs or projections and depressions can be arranged can be the one of either the length or width of the diaphragm 15, as shown in FIGS. 6 and 7. By disposing the structural reinforcement member 15*h* in the top portion 15*a*, the rigidity of the diaphragm 15 can be further improved and the performance of the electromagnetic converter 10 can be improved.

Furthermore, in above-mentioned embodiment 1, the method of forming the voice coil patterns 15*g* with edging before hot-press-forming the diaphragm 15 is explained, through the present embodiment is not limited to this method. As an alternative, the voice coil patterns 15*g* can be printed and formed on the diaphragm 15 yet-to-be-solid-formed, or coils can be stuck onto the diaphragm 15 which has been solid-formed to form the voice coil patterns 15*g* on the diaphragm.

Many widely different embodiments of the present invention may be constructed without departing from the spirit and scope of the present invention. It should be understood that the present invention is not limited to the specific embodiments described in the specification, except as defined in the appended claims.

What is claimed is:

1. An electromagnetic converter comprising: a magnetic circuit having a permanent magnet, a frame fixing one magnetic pole face of said permanent magnet thereto and having an opening on a side of another magnetic pole face of said permanent magnet, and a plate fixed to said other magnetic pole face; a diaphragm having a top portion positioned to cover said plate and four side portions formed in such a way as to extend from said top portion toward said permanent magnet, and positioned between said plate and said opening of said frame, and having a voice coil pattern formed on one surface or both surfaces thereof; a first holding portion joined to a periphery of the top portion of said diaphragm, and a periphery of said opening of said frame, for holding said diaphragm in such a way that said diaphragm can move; and a second holding portion joined to edges of side portions of said diaphragm, and an inner surface of said frame, for holding said diaphragm in such a way that said diaphragm can move wherein the top portion and the four side portions of the diaphragm are made of the same material, wherein said diaphragm is made from a thermoplastic resin sheet, and the four side portions of said diaphragm are formed by hot press forming both sides in a direction of a length of the sheet and both sides in a direction of a width of the sheet, and the voice coil pattern is arranged on both the side portions in said direction of the length of the sheet and on the top portion.

2. The electromagnetic converter according to claim 1, wherein the diaphragm has a beltlike reinforcement portion joining between two side portions facing each other.

3. The electromagnetic converter according to claim 1, wherein the top portion of the diaphragm has a rib structure or a rugged structure for reinforcement.

4. The electromagnetic converter according to claim 2, wherein the beltlike reinforcement portion of the diaphragm has a rib structure or a rugged structure for reinforcement.

5. The electromagnetic converter according to claim 1, wherein voice coil patterns are formed on both front and rear surfaces of side portions of the diaphragm respectively, and partially overlap each other.

6. The electromagnetic converter according to claim 1, wherein the first holding portion is made from a material through which air can pass or has a structure which enables air to pass therethrough.

* * * * *